US006276017B1

(12) United States Patent
Lino et al.

(10) Patent No.: US 6,276,017 B1
(45) Date of Patent: Aug. 21, 2001

(54) MULTISIZE BIDIRECTIONAL SCRAPING DEVICE

(75) Inventors: Antonio Carlos Ferreira Lino; Marcelino Guedes Ferreira Mosqueira Gomes; Fernando Borja Pereira, all of Rio de Janeiro (BR)

(73) Assignee: Petroleo Brasileiro S.A. - Petrobras (BR)

( * ) Notice: Subject to any disclaimer, the term of this patent is extended or adjusted under 35 U.S.C. 154(b) by 0 days.

(21) Appl. No.: 09/313,363

(22) Filed: May 18, 1999

(30) Foreign Application Priority Data

May 26, 1998 (BR) ..... 9801690

(51) Int. Cl.[7] ..... B08B 9/053

(52) U.S. Cl. ..... 15/104.061; 15/104.16; 15/104.2; 15/104.063

(58) Field of Search ..... 15/104.061, 104.16, 15/104.05, 104.2, 104.063

(56) References Cited

U.S. PATENT DOCUMENTS

| | | | | |
|---|---|---|---|---|
| 329,605 | * | 11/1885 | Warren | 15/104.061 |
| 1,516,880 | * | 11/1924 | Bowman | 15/104.061 |
| 1,547,440 | * | 7/1925 | Penn | 15/104.061 |
| 2,392,144 | * | 1/1946 | Hall | 15/104.061 |
| 3,530,523 | | 9/1970 | Ver Nooy | 15/104.061 |
| 3,619,844 | * | 11/1971 | Collins et al. | 15/104.061 |
| 3,673,629 | * | 7/1972 | Casey et al. | 15/104.061 |
| 3,857,132 | * | 12/1974 | Knapp et al. | 15/104.061 |
| 3,875,606 | | 4/1975 | Landers | 15/104.061 |
| 3,879,790 | * | 4/1975 | Girard | 15/104.061 |
| 3,939,519 | * | 2/1976 | Muirhead | 15/104.061 |
| 4,069,535 | * | 1/1978 | Cato | 15/104.061 |
| 4,242,771 | * | 1/1981 | Knapp | 15/104.061 |
| 4,356,865 | * | 11/1982 | Appel et al. | 15/104.061 |
| 4,406,031 | | 9/1983 | Eimer | 15/104.061 |
| 5,457,841 | * | 10/1995 | Minton | 15/104.061 |
| 5,600,863 | * | 2/1997 | Curran | 15/104.061 |
| 5,685,041 | * | 11/1997 | Sivacoe | 15/104.061 |
| 5,964,004 | * | 10/1999 | Bean | 15/104.16 |

FOREIGN PATENT DOCUMENTS

| | | |
|---|---|---|
| 0 041 698 | 12/1981 | (EP) . |
| 2 273 543 | 6/1994 | (GB) . |

* cited by examiner

*Primary Examiner*—Robert J. Warden, Sr.
*Assistant Examiner*—Theresa T. Snider
(74) *Attorney, Agent, or Firm*—Nixon & Vanderhye PC

(57) ABSTRACT

The present invention relates to a device 10 for scraping the inner walls of a pipeline. The device has (i) a flexible shaft 16 of elastomeric material, (ii) a plurality of groups of flexible radial scraping bars 14 which are spaced apart and offset angularly so that the bars are able to scrape substantially the entire inner surface of the pipeline, and (iii) a flexible covering 12 which coats the entire assembly formed by the said flexible shaft and by the bars, with the exception of the outer ends of the bars.

16 Claims, 4 Drawing Sheets

MULTISIZE BIDIRECTIONAL SCRAPING DEVICE

FIELD OF THE INVENTION

The present invention relates to a device for scraping the inner walls of a pipeline. More particularly, the present invention relates to a device for removing material adhering to the inner walls of a pipeline conveying a flow of petroleum.

PRIOR ART

During operation of a fluid-flow system using pipelines, material originating from the flow may adhere to the inner walls of the pipeline, which causes the area of the cross section of the pipeline to be reduced and this adversely affects the flow of fluid and, consequently, reduces the flow rate of the fluid passing through the pipeline.

The rate of deposition of material on the inner walls of a pipeline will depend on a number of factors: for example the composition of the fluid, the volume flow rate, the temperature of the fluid, the geometry of the pipeline, etc. In the case of pipelines used for the flow of the petroleum production of offshore production wells, in which the petroleum has for example a high paraffin content, situations arise in which the rate of deposition is very high.

When the production wells are located in deep waters, around 1000 m or more, the thermal differential between (i) the temperature of the petroleum which is flowing through the pipeline and which emerges at the well head at relatively high temperatures, and (ii) the temperature of the seawater, which is generally fairly low, accelerates the process of deposition of organic material on the inner walls of the pipeline. This may be exacerbated by the fact that the pipeline usually crosses relatively long distances along the seabed, up to a point where either it is connected to a manifold or it rises in order to be connected to a surface collection point.

To maintain the flow capacity of the pipeline in accordance with its original characteristics, use is regularly made of a scraping device which is passed through inside the pipeline and driven along by the actual flow. As this scraper passes through the inside of the pipeline, it removes the layers of organic material adhering to the inner walls of the pipeline, thereby maintaining the pipeline in good condition for the petroleum production to flow through.

When the internal diameter of the pipelines through which a scraping device passes is constant, there will normally be no problems concerning scraper performance when a complete scraping cycle is carried out. However, when operation involves flow systems which comprise pipelines of different diameters, which is a very common occurrence in offshore petroleum flow systems, the need arises for use to be made of scraping devices which are capable of passing through all the pipelines without a loss in scraping efficiency.

In such situations, use is made of a multisize scraping device capable of passing through sections of pipeline with different internal diameters. Scraping devices are available which are capable of passing through different sections of pipeline in which the largest diameter is approximately double the smallest diameter, and in such situations there is a significant loss of scraping efficiency.

However, situations may arise in which the scraping device becomes stuck in a certain section of pipeline, for example owing to the excessive accumulation of material. In such a situation, the most immediate possibility of recovering the scraping device consists of reversing the flow of fluid so that the scraping device is then conveyed, by the flow of fluid, in the opposite direction from its original direction of movement so that it is possible for it to be recovered at the point from where it was originally launched.

The multisize scraping devices known in the prior art do not have the characteristic of being bidirectional. There are reports of situations in which the prior art scraping devices do succeed in operating as if they were bidirectional, but results are unreliable. There is therefore a need for a multisize scraping device which is genuinely bidirectional.

As will be seen in the following description, the present invention relates to a multisize scraping device which has the characteristic of being bidirectional.

SUMMARY OF THE INVENTION

The present invention relates to a multisize bidirectional scraping device which comprises a flexible shaft of flexible elastomeric material; a plurality of groups of flexible radial scraping bars of flexible elastomeric material, spaced along the flexible shaft and offset angularly; and a flexible covering which covers the entire assembly formed by the flexible shaft and by the plurality of groups of flexible, radial scraping bars, with the exception of the outer ends of the radial scraping bars.

Use may be made, at the ends of the flexible shaft, of a guide disc of flexible elastomeric material, the function of which is basically to improve the centering of the multisize bidirectional scraping device when it passes through a transition from the largest diameter to the smallest diameter of a pipeline.

The outer surface of the flexible covering may also be coated with a layer of elastomeric material with high abrasion resistance, as a way in which to lengthen the service life of the coating.

The flexible radial scraping bars may be stiffened by means of the use, inside them, of metallic materials which have a "shape-memory" characteristic, in order to enhance the scraping effect of the scraping bars.

BRIEF DESCRIPTION OF THE DRAWINGS

The invention will now be described in greater detail in conjunction with the accompanying drawings given purely by way of example, and which form an integral part of the present specification.

In the drawings.

DETAILED DESCRIPTION OF THE INVENTION

Figure 1:
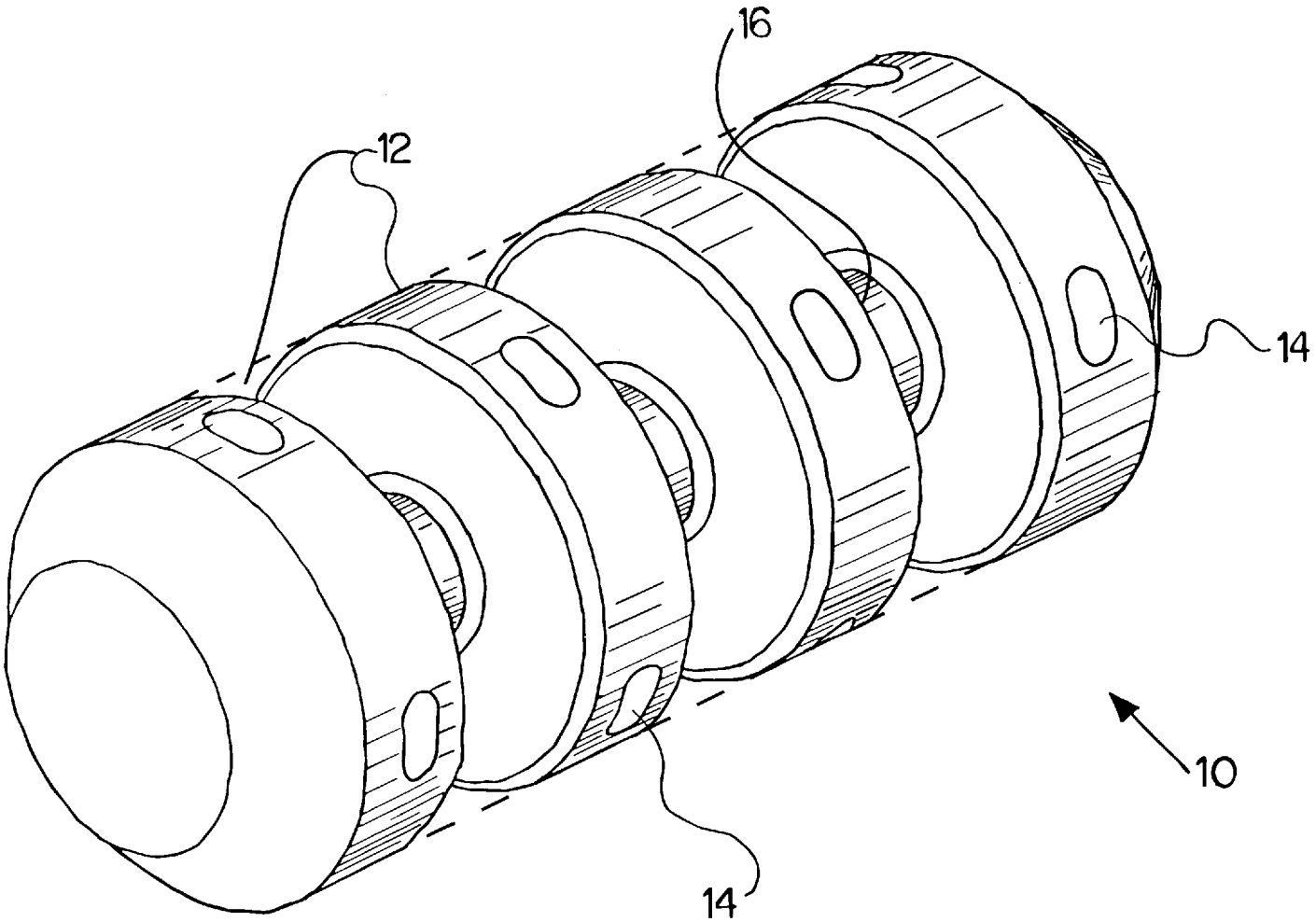
FIG. 1 is a perspective view of an embodiment of the multisize bidirectional scraping device of the present invention.
Figure 2:
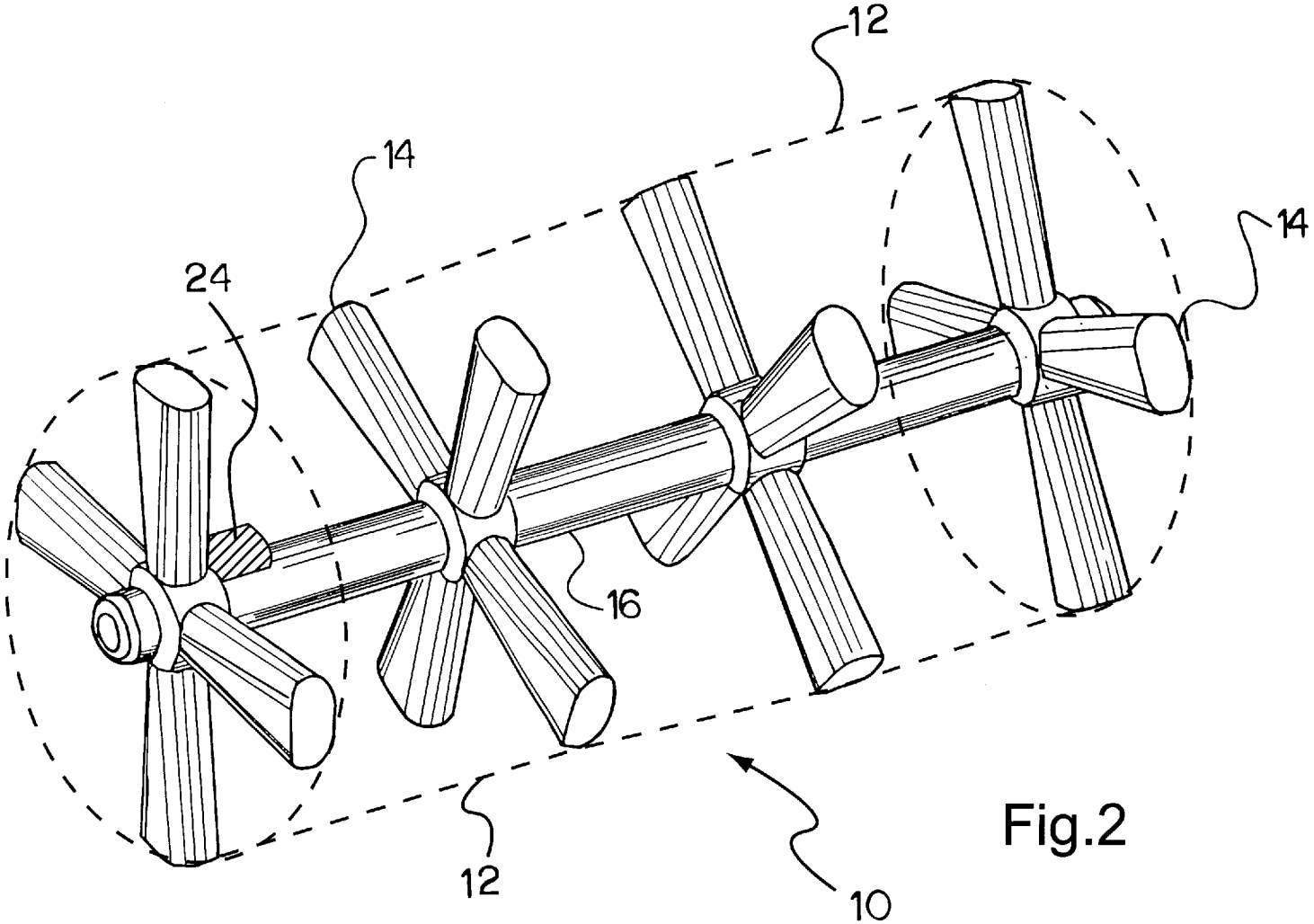
FIG. 2 is a perspective view showing the flexible shaft of an embodiment of the multisize bidirectional scraping device of the present invention, to which flexible radial scraping bars are secured.

FIGS. 1 and 2, respectively, show a multisize bidirectional scraping device 10 of the present invention, and show its flexible shaft 16 to which a plurality of groups of flexible radial scraping bars 14 are secured. Both the flexible shaft 16 and the flexible radial scraping bars 14 are manufactured from a flexible elastomeric material, preferably polyurethane. FIG. 1 shows that the scraping device is covered with a flexible covering 12, preferably of foam, in this case a medium-density polyurethane foam. The covering 12 is shown in phantom lines in FIGS. 2 and 4 and partly in phantom in FIGS. 1 and 3 to selectively illustrate the shaft 16 and scraping bar structures 14.

As may be seen in FIG. 2, the groups of flexible, radial scraping bars 14 are spaced along the flexible shaft 16 and offset angularly, for reasons which will be elaborated upon below. In the present embodiment, purely by way of illustrative example, use is made of four groups of flexible radial scraping bars 14, each group containing four of the flexible radial scraping bars 14.

The flexible covering 12 encases the entire multisize bidirectional scraping device 10, with the exception of the outer ends of the flexible radial scraping bars 14 which remain exposed. In this way, the flexible covering 12 has a sealing effect, i.e. it is compressed against the inner walls of the pipeline through which it is passing. Consequently, when the multisize bidirectional scraping device 10 is inserted inside a pipeline, the seal promoted by the flexible covering 12 causes the flow of fluid to push the multisize bidirectional scraping device 10, moving it through the inside of the pipeline.

The material adhering to the inner walls of the pipeline is scraped off by the flexible covering 12 and the scraping effect is enhanced by the flexible radial scraping bars 14. As mentioned above, and as shown in FIG. 2, the groups of flexible radial scraping bars 14 are spaced apart and are offset angularly. The groups of flexible, radial scraping bars 14 are fitted in this way so that substantially the entire circumference of the inner wall of a pipeline through which the multisize bidirectional scraping device 10 passes is subjected to the scraping effect.

In other words, when the multisize bidirectional scraping device 10 has passed through the inside of a specific length of a pipeline equivalent to the length of the multisize bidirectional scraping device 10, the arrangement of the groups of flexible, radial scraping bars 14 preferably guarantees that the entire inner wall of the section of pipeline will be scraped by at least one flexible, radial scraping bar 14; this requires that the flexible radial scraping bars 14 are arranged in such a manner that the projection of the tips of the bars on a plane perpendicular to the axis of the shaft 16 covers 360° of arc.

When the multisize bidirectional scraping device 10 is inserted inside a pipeline, it is pushed along by the actual flow of fluid, as mentioned above. As the pipeline diameter is chosen to be smaller than the external diameter of the multisize bidirectional scraping device 10, the flexible covering 12 is compressed and the radial scraping bars 14 are forced to bend in the direction opposite to the direction of movement. The resilience of the flexible radial scraping bars causes them to tend to seek their original orthogonal position, thereby forcing them against the inner walls of the pipeline. In this way, the desired scraping effect is enhanced.

The materials of the flexible covering 12, of the flexible, radial scraping bars 14, and of the flexible shaft 16, are relatively flexible and consequently the multisize bidirectional scraping device 10 can easily pass through the inside of pipelines, the internal diameter of which is substantially less than its external diameter, and through the inside of curved sections or other uneven sections.

As the two ends of the multisize bidirectional scraping device 10 are identical in shape, the device may be inserted inside a pipeline with either of its two ends facing forwards. In this way, if the multisize bidirectional scraping device 10 becomes caught inside a pipeline, it will suffice to reverse the direction of flow so that the device then moves in a direction which is the opposite of the direction in which it was originally launched, which will facilitate its recovery at the launching point, or at any other place suitable for this purpose.

Figure 3:
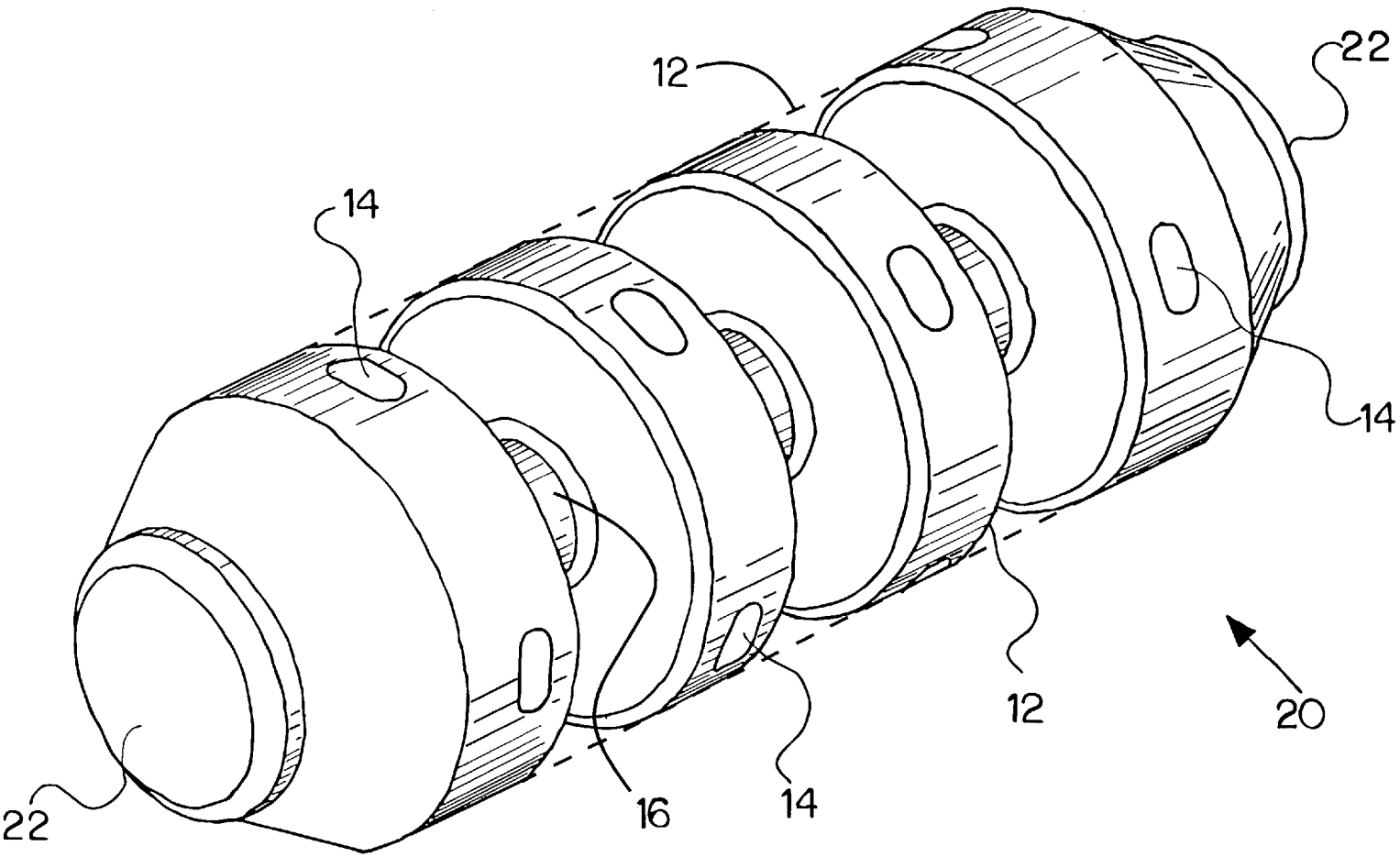
FIG. 3 is a perspective view of a second embodiment of the multisize bidirectional scraping device of the present invention.
Figure 4:
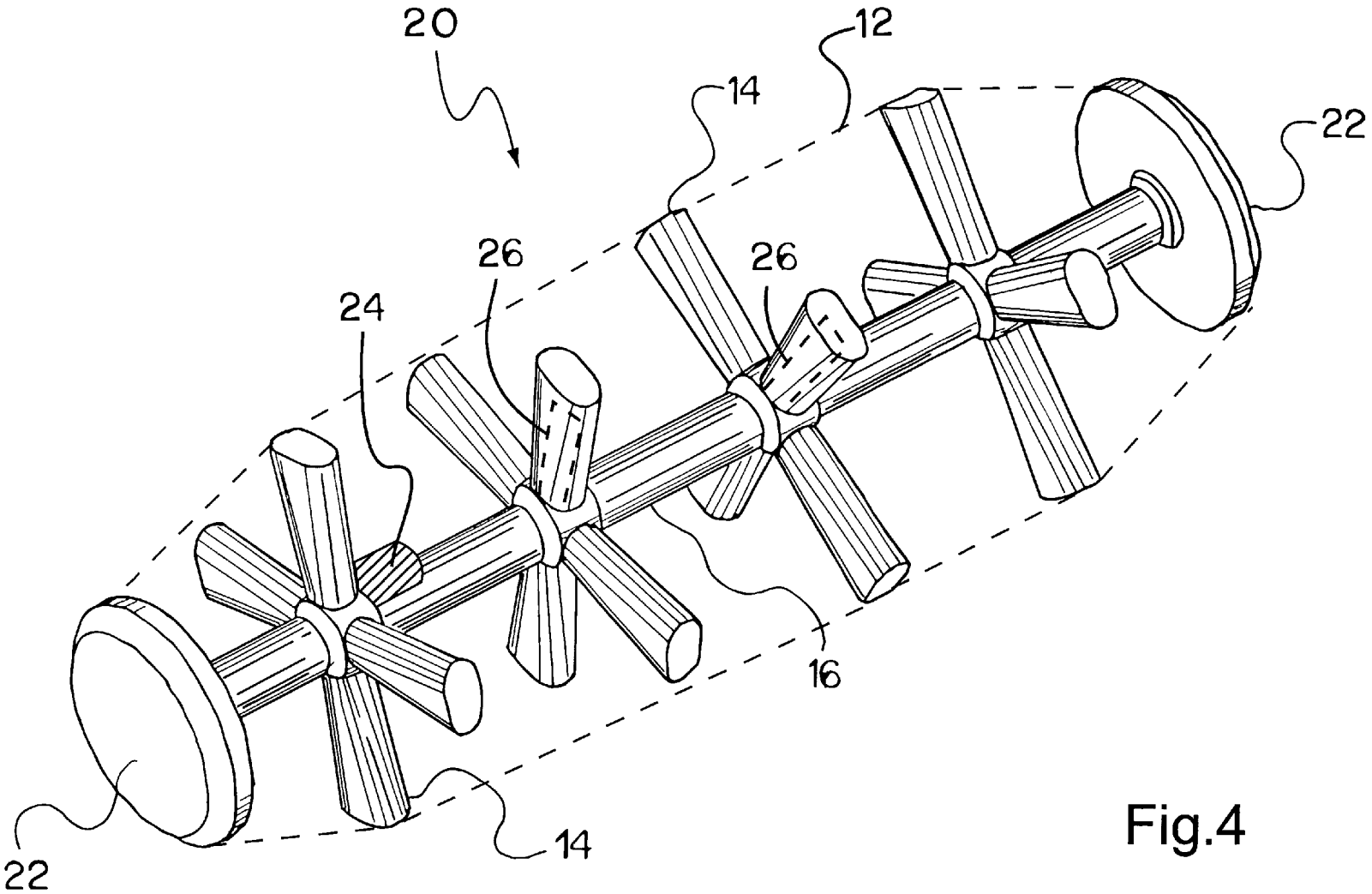
FIG. 4 is a perspective view showing the flexible shaft of the second embodiment of the multisize bidirectional scraping device of the present invention, to which flexible radial scraping bars are secured.

FIG. 3 shows a second embodiment of a multisize bidirectional scraping device in accordance with the present invention. The only difference between this embodiment and the embodiment described above with reference to FIGS. 1 and 2 is the use of at least one guide disc 22 at each end of the flexible shaft 16, as may be better seen in FIG. 4. The function of the guide discs 22 is basically to improve the centering of this type of multisize bidirectional scraping device 20 as it passes through a transition from the largest diameter to the smallest diameter of the pipeline.

As the wear on the flexible covering 12 is significant, a thin layer of elastomeric material with high abrasion resistance, for example polyurethane, may be deposited on its outer surface which contacts the pipe wall, as a way in which to lengthen its service life.

The flexible radial scraping bars 14 may be stiffened by using, inside them, metallic materials, schematically illustrated as components 26, which have a characteristic known as "shape memory". These are materials which, after undergoing deformation, tend to return to their original shape, recovering their mechanical characteristics. In this way, the scraping effect of the flexible radial scraping bars 14 is enhanced.

A magnet 24 may also be placed at some point on the multisize bidirectional scraping device, which will allow the use of equipment to detect the passage of the device inside the pipeline. For the purposes of simplification, a description of the process whereby the passage of the multisize bidirectional scraping device is detected inside a specific point of a pipeline will not be described here as it does not form an integral part of the present invention and is also known to a large number of specialists.

The groups of flexible radial scraping bars 14 may be of integral construction with the flexible shaft 16 or may be secured to the flexible shaft 16 in some way. In the second possibility, the groups of flexible radial scraping bars 14 must be secured to the flexible shaft 16 in a secure manner, guaranteeing that the scraping bars 14 will not become detached when the multisize bidirectional scraping device passes through the inside of a pipeline.

The expert in this technical field will appreciate that alterations and substitutions may be made without departing from the basic concepts described herein, and that the description given above of the embodiments of the multisize bidirectional scraping device should not be regarded as limiting the invention, which is limited only by the scope of the appended claims.

What is claimed is:

1. A multisize bidirectional scraping device for use in removing material adhering to the inner walls of a pipeline, said device being able to be moved along the pipeline by means of the actual flow of the fluid flowing, wherein it comprises:

a flexible shaft of elastomeric material having two ends;

a plurality of groups of flexible radial scraping bars secured to said flexible shaft which are spaced apart and offset angularly so that outer ends of said flexible radial scraping bars are able to scrape substantially the entire inner surface of said pipeline; and a flexible covering which covers the entire assembly formed by said flexible shaft and by said bars, with the exception of the outer ends of the bars.

2. Device according to claim 1, wherein a guide disc is located at each one of the ends of the said flexible shaft.

3. Device according to claim 2, wherein a layer of abrasion-resistant elastomeric material is located on that surface of the flexible covering which contacts the pipeline walls in use of the device.

4. Device according to claim 3, wherein said flexible radial scraping bars have, inside them, metallic materials with a shape-memory characteristic, in order to enhance their scraping effect.

5. Device according to claim 4, wherein a magnet is placed at any point of the device, to facilitate detection of the passage of the device inside a pipeline.

6. Device according to claim 3, wherein a magnet is placed at any point of the device, to facilitate detection of the passage of the device inside a pipeline.

7. Device according to claim 2, wherein said flexible radial scraping bars have, inside them, metallic materials with a shape-memory characteristic, in order to enhance their scraping effect.

8. Device according to claim 7, wherein a magnet is placed at any point of the device, to facilitate detection of the passage of the device inside a pipeline.

9. Device according to claim 2, wherein a magnet is placed at any point of the device, to facilitate detection of the passage of the device inside a pipeline.

10. Device according to claim 1, wherein a layer of abrasion-resistant elastomeric material is located on that surface of the flexible covering which contacts the pipeline walls in use of the device.

11. Device according to claim 10, wherein said flexible radial scraping bars have, inside them, metallic materials with a shape-memory characteristic, in order to enhance their scraping effect.

12. Device according to claim 11, wherein a magnet is placed at any point of the device, to facilitate detection of the passage of the device inside a pipeline.

13. Device according to claim 10, wherein a magnet is placed at any point of the device, to facilitate detection of the passage of the device inside a pipeline.

14. Device according to claim 1, wherein said flexible radial scraping bars have, inside them, metallic materials with a shape-memory characteristic, in order to enhance their scraping effect.

15. Device according to claim 14, wherein a magnet is placed at any point of the device, to facilitate detection of the passage of the device inside a pipeline.

16. Device according to claim 1, wherein a magnet is placed at any point of the device, to facilitate detection of the passage of the device inside a pipeline.

* * * * *